US011988011B2

(12) United States Patent
Burt et al.

(10) Patent No.: US 11,988,011 B2
(45) Date of Patent: May 21, 2024

(54) RAKING BARRIER PANEL

(71) Applicant: Fortress Iron, LP, Garland, TX (US)

(72) Inventors: Kevin T. Burt, Dallas, TX (US); Kevin B. Flatt, Garland, TX (US); Geoff T. Luczycki, Garland, TX (US); Yihong Zhang, Garland, TX (US); Matthew Carlyle Sherstad, Dallas, TX (US); Evan Timmons, Arlington, TX (US); Xiaoning Wang, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 17/341,874

(22) Filed: Jun. 8, 2021

(65) Prior Publication Data

US 2021/0293049 A1 Sep. 23, 2021

Related U.S. Application Data

(63) Continuation of application No. 15/865,149, filed on Jan. 8, 2018, now Pat. No. 11,035,147.

(51) Int. Cl.
*E04H 17/14* (2006.01)

(52) U.S. Cl.
CPC ..... *E04H 17/1426* (2013.01); *E04H 17/1439* (2013.01)

(58) Field of Classification Search
CPC ..... E04F 11/1834; E04H 17/1426; E04H 17/1439; E04H 17/1448; E04H 2017/1478;

(Continued)

(56) References Cited

U.S. PATENT DOCUMENTS 9,420 A 11/1852 Hess
2,218,953 A 10/1940 Gustafson (Continued)

FOREIGN PATENT DOCUMENTS

EP 1 538 283 B1 6/2007
GB 0 599 042 A 3/1948

(Continued)

OTHER PUBLICATIONS

International Search Report and Written Opinion for International Application No. PCT/US2019/012389, dated Apr. 1, 2019, 10 pages.

(Continued)

*Primary Examiner* — Josh Skroupa
(74) *Attorney, Agent, or Firm* — Foley & Lardner LLP; John J. May

(57) ABSTRACT

A raking barrier panel includes a plurality of pickets, each defining a pivot pin hole. A channel member includes a web wall defining a plurality of spaced apart openings that each receives a respective one of the plurality of pickets therethrough. A plurality of picket pivot members are in snap-fit engagement with the channel member, and each one of the plurality of picket pivot members includes a pair of opposed end walls and a pair of opposed side walls together forming a box-like shape. A pivot pin extends from at least one of the pair of opposed side walls and is received by the pivot pin hole of a respective one of the plurality of pickets to define a pivot axis with respect to the channel member.

20 Claims, 10 Drawing Sheets

(58) Field of Classification Search
CPC ..... E04H 2017/1482; E04H 2017/1492; F16B 7/0446
USPC ..... 256/22, 47, 67
See application file for complete search history.

(56) References Cited

U.S. PATENT DOCUMENTS

| | | | | |
|---|---|---|---|---|
| 2,563,530 | A | 8/1951 | Hawkins | |
| 2,655,345 | A | 10/1953 | Lindman | |
| 2,715,513 | A | 8/1955 | Kools | |
| 3,033,532 | A | 5/1962 | Mcfall | |
| 3,067,985 | A | 12/1962 | Cusack | |
| 3,136,530 | A | 6/1964 | Case | |
| 3,174,727 | A | 3/1965 | Burt et al. | |
| 3,202,401 | A | 8/1965 | Bastia | |
| 3,258,251 | A | 6/1966 | Culter | |
| 3,910,561 | A | 10/1975 | Fornells | |
| 3,960,367 | A | 6/1976 | Rogers et al. | |
| 4,690,440 | A | 9/1987 | Rogers | |
| 4,723,760 | A | 2/1988 | O'Sullivan | |
| 4,871,203 | A | 10/1989 | Rogers | |
| 4,932,693 | A | 6/1990 | Schwartz | |
| 4,968,005 | A | 11/1990 | Zen | |
| 5,136,813 | A | 8/1992 | Gibbs et al. | |
| 5,167,049 | A | 12/1992 | Gibbs | |
| 5,254,064 | A | 10/1993 | Rock | |
| 5,272,838 | A | 12/1993 | Gibbs | |
| 5,345,723 | A | 9/1994 | Gibbs | |
| 5,443,244 | A | 8/1995 | Gibbs | |
| 5,454,548 | A | 10/1995 | Moore | |
| 5,660,378 | A | 8/1997 | Schall | |
| 6,142,451 | A | 11/2000 | Lindsey et al. | |
| 6,173,945 | B1 | 1/2001 | Lindsey et al. | |
| 6,176,043 | B1 | 1/2001 | Gibbs | |
| 6,299,143 | B1 | 10/2001 | Valentine | |
| 6,341,764 | B1 * | 1/2002 | Conner | E04H 17/1439 256/19 |
| 6,530,561 | B2 | 3/2003 | Larsen et al. | |
| 6,568,658 | B2 | 5/2003 | Strome | |
| D479,612 | S | 9/2003 | Larsen et al. | |
| 6,631,887 | B1 | 10/2003 | Walmsley et al. | |
| 6,648,304 | B1 | 11/2003 | Zhu | |
| D489,136 | S | 4/2004 | Schwartz et al. | |
| 6,739,583 | B2 | 5/2004 | Ryon | |
| 6,752,385 | B2 | 6/2004 | Zen et al. | |
| 6,752,386 | B1 | 6/2004 | Bundy | |
| 6,811,145 | B2 | 11/2004 | Gibbs et al. | |
| 6,824,123 | B2 | 11/2004 | Larsen et al. | |
| 7,032,890 | B2 | 4/2006 | Svalbe | |
| 7,071,439 | B2 | 7/2006 | Gibbs et al. | |
| 7,086,642 | B1 | 8/2006 | O'Brien | |
| 7,100,904 | B2 | 9/2006 | Kim et al. | |
| 7,152,849 | B2 * | 12/2006 | Graber | E04H 17/1439 256/22 |
| 7,384,025 | B2 | 6/2008 | Lo | |
| 7,677,535 | B1 | 3/2010 | Lo | |
| 8,356,801 | B2 | 1/2013 | Howard et al. | |
| 8,413,332 | B2 | 4/2013 | Duffy et al. | |
| 8,413,965 | B2 | 4/2013 | Duffy et al. | |
| 8,523,150 | B2 | 9/2013 | Gibbs et al. | |
| 8,695,948 | B2 | 4/2014 | Stinson | |
| 8,695,949 | B2 | 4/2014 | Stinson | |
| 8,833,737 | B2 | 9/2014 | Langenwalter et al. | |
| 8,887,370 | B2 | 11/2014 | Payne et al. | |
| 8,899,555 | B2 * | 12/2014 | Sherstad | E04H 17/1439 256/65.01 |
| 9,151,075 | B2 | 10/2015 | Duffy et al. | |
| 9,234,368 | B2 * | 1/2016 | Zhu | E04H 17/1439 |
| 9,404,283 | B1 | 8/2016 | Lo | |
| 9,435,134 | B2 | 9/2016 | Walmsley | |
| 9,482,028 | B2 | 11/2016 | Springborn | |
| 9,551,164 | B2 | 1/2017 | Duffy et al. | |
| 9,637,932 | B2 | 5/2017 | Schneider et al. | |
| 9,695,612 | B2 | 7/2017 | Batts, III | |
| 9,963,905 | B2 | 5/2018 | Duffy et al. | |
| 2002/0175321 | A1 | 11/2002 | Larsen et al. | |
| 2003/0151039 | A1 | 8/2003 | Zen et al. | |
| 2003/0209700 | A1 | 11/2003 | Gibbs | |
| 2004/0051092 | A1 | 3/2004 | Curatolo | |
| 2005/0071983 | A1 | 4/2005 | Larsen et al. | |
| 2005/0092978 | A1 | 5/2005 | Gibbs et al. | |
| 2005/0098771 | A1 | 5/2005 | Demaere | |
| 2005/0199864 | A1 | 9/2005 | Gibbs et al. | |
| 2005/0205854 | A1 | 9/2005 | Gibbs et al. | |
| 2006/0076546 | A1 | 4/2006 | Bertato | |
| 2006/0169965 | A1 | 8/2006 | Paskar | |
| 2007/0278467 | A1 | 12/2007 | Ash | |
| 2008/0111119 | A1 | 5/2008 | Platt | |
| 2008/0121857 | A1 | 5/2008 | Lo | |
| 2009/0026431 | A1 | 1/2009 | Tremblay et al. | |
| 2010/0096608 | A1 | 4/2010 | McCarthy et al. | |
| 2010/0264388 | A1 | 10/2010 | Duffy et al. | |
| 2011/0001105 | A1 | 1/2011 | Lo | |
| 2011/0233498 | A1 | 9/2011 | Stinson | |
| 2011/0233499 | A1 | 9/2011 | Stinson | |
| 2013/0181179 | A1 | 7/2013 | Langenwalter et al. | |
| 2018/0030754 | A1 | 2/2018 | Leone | |

FOREIGN PATENT DOCUMENTS

| | | |
|---|---|---|
| GB | 2 109 434 | 6/1983 |
| GB | 2 393 741 | 4/2004 |
| WO | WO-02/072982 A1 | 9/2002 |
| WO | WO-02072982 | 9/2002 |
| WO | WO-2007/119039 A1 | 10/2007 |
| WO | WO-2009/067027 A2 | 5/2009 |

OTHER PUBLICATIONS

*Barrette Outdoor Living, Inc.* v. *Fortress Iron L.P*, Cause No. 3:21-CV-02008-E in U.S. District Court of Northern Dist. of Texas, Dallas Div., Jury Trial Demanded, Defendant's Preliminary Invalidity Contentions and Exhibits 1-16, Jan. 18, 2022, pp. 579.

* cited by examiner

RAKING BARRIER PANEL

CROSS-REFERENCE TO RELATED APPLICATIONS

This application is a continuation of U.S. patent application Ser. No. 15/865,149, filed on Jan. 8, 2018, now pending, the disclosure of which is incorporated herein by reference.

The present application is related to U.S. Pat. No. 8,899,555, entitled "Adjustable Picket Fence," filed on Sep. 4, 2008, which claims the benefit of U.S. Provisional Application for Patent 60/970,473 filed Sep. 6, 2007 entitled "Barrier System," the disclosures of which are hereby incorporated by reference.

BACKGROUND OF THE INVENTION

Technical Field of the Invention

The present invention relates to barriers to pedestrians or vehicles, and more particularly to fences and fence components.

Description of Related Art

Metal fences of various kinds are well known in the art. Such metal fences are typically assembled from stock metal components making up the rails and pickets (uprights) joined together through a welding process. The assembled components form a fence panel of generally rectangular shape. Vertical posts are mounted in the ground (for example, through a cement footing or base), and a fence panel extends between, and is mounted to, a pair of vertical posts. Alternatively, two or more of the upright members in the fence panel extend below a lower-most one of the rail members. The extensions of the upright members allow for the fence panel to be installed in the ground.

It is commonplace for there to exist uneven, sloping ground topography where a fence needs to be installed. The installation of rigidly assembled metal fence panels on such topography is difficult because of the aesthetic need for the vertical parts of the fence, the posts and uprights (pickets), to be vertically oriented. This requires either the manufacture of custom fence panels designed for the pitch of the underlying ground topography, or for the vertical offsetting of adjacent fence panels along the length of the fence line to account for the sloping terrain.

There exists a need in the art for a metal fence panel having an adjustable racking capability so that the fence panel can be used in connection with fence installations on either horizontal or sloping terrain. Preferably, the needed panel with a racking capability will be economically manufacturable and easy to install.

SUMMARY OF THE INVENTION

In an embodiment, a raking barrier panel includes a plurality of upright members and a rail assembly. The rail assembly is pivotally coupled to the plurality of upright members, and it includes a first inner rail disposed on a first side of the plurality of upright members. A plurality of fasteners pivotally couples the plurality of upright members to the first inner rail. A channel member includes a web portion and first and second side walls extending from the web portion. A first rib extends from the first side wall and is in engagement with the first inner rail, and the first and second side walls extend beyond the first rib.

Certain embodiments may include joining means, such as spot welds or amounts of adhesive that are spaced apart along the length of the panel that are concealed by the first and second side walls. An alternate embodiment includes a pair of inner picket rails disposed on opposite sides of the plurality of upright members. Technical advantages of embodiments according to the teaching of the present disclosure include a raking barrier panel whose manufacture is simplified, and installation of the barrier panel at a variety or rake angles is simplified.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1A:
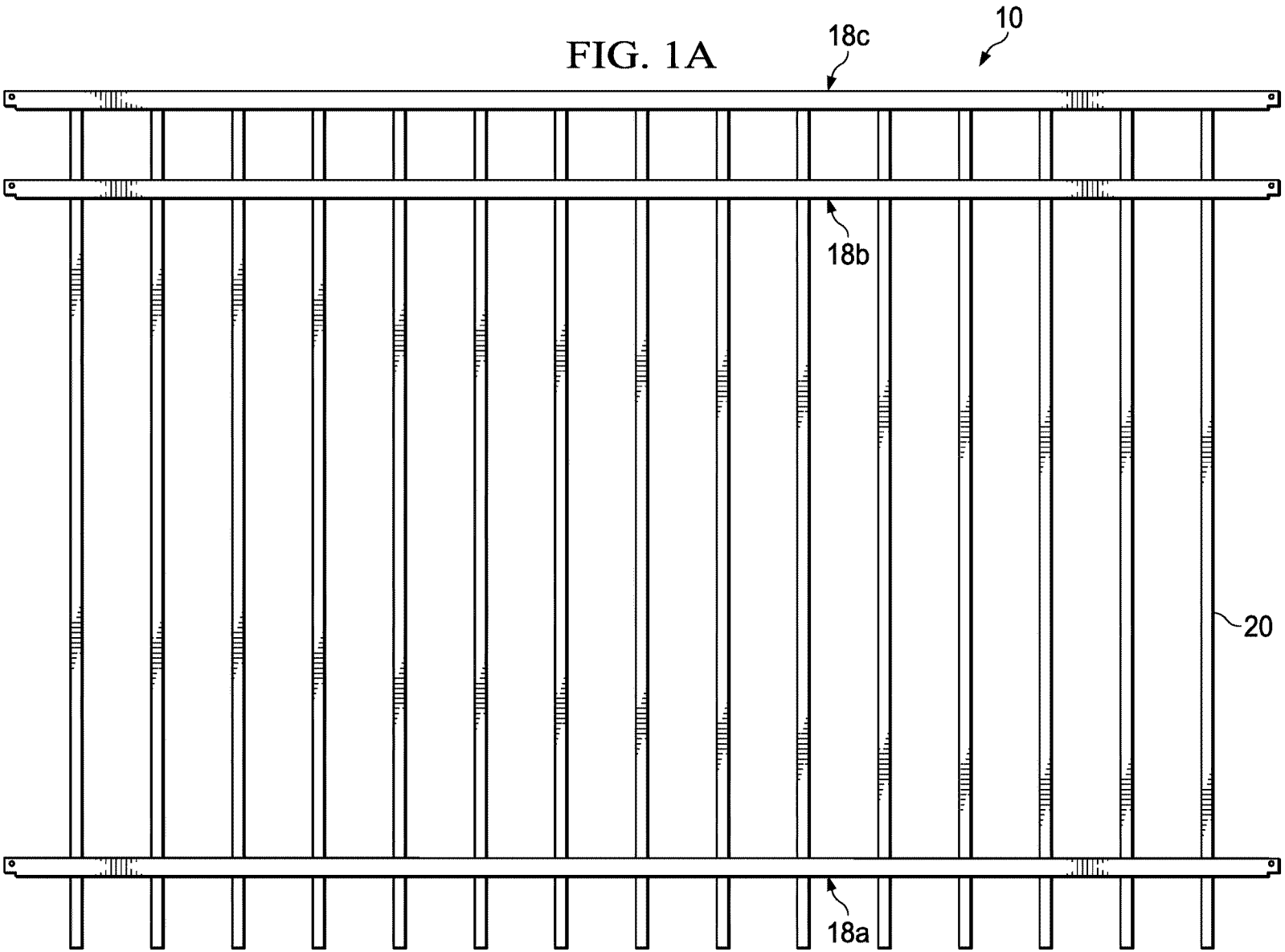
FIG. 1A shows a raking barrier panel in a square configuration.
Figure 1B:
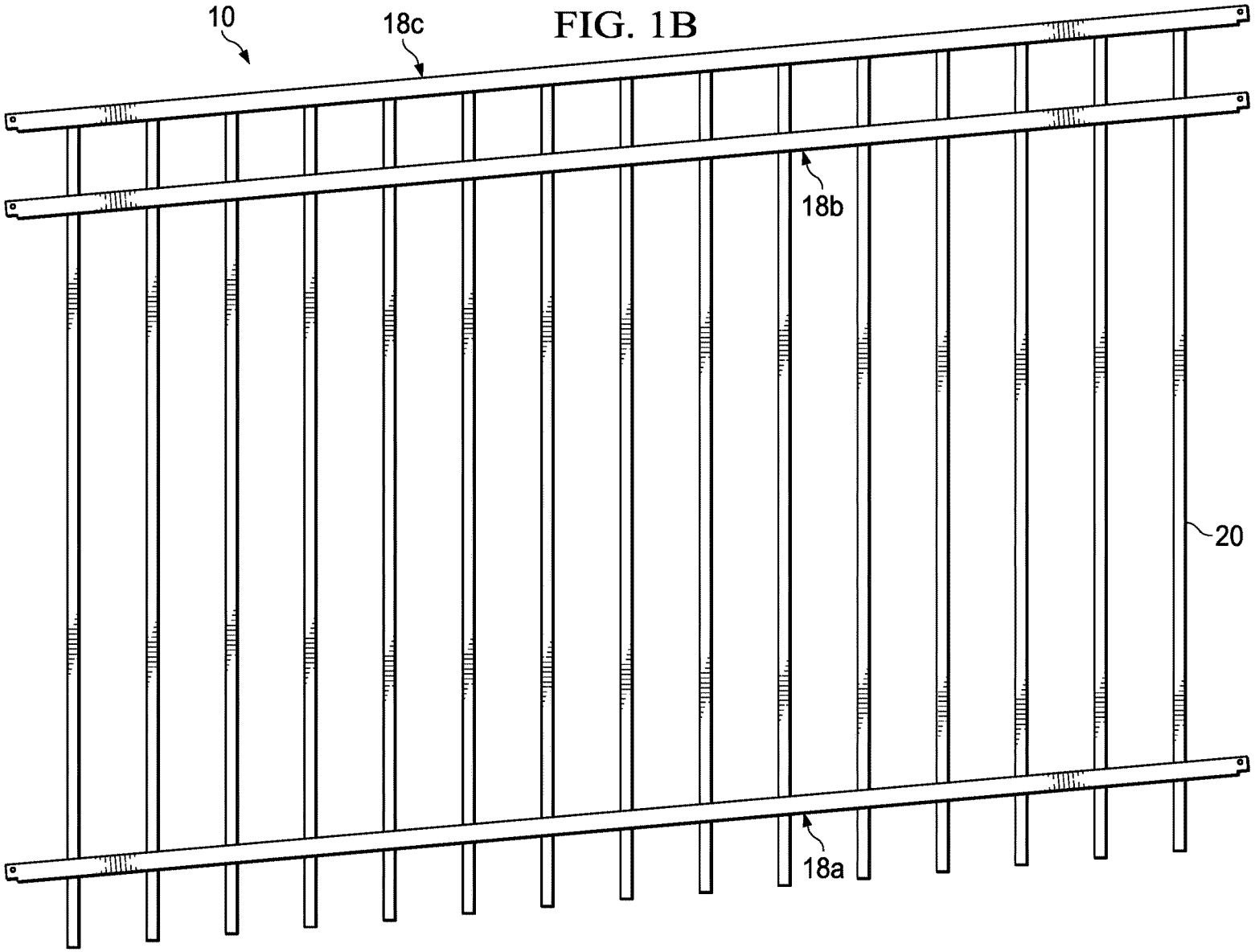
FIG. 1B shows the raking barrier panel of FIG. 1A in a raked configuration for example in a fence on sloping terrain.

Embodiments disclosed herein relate to a barrier system, such as a fence, picket fence, fence panel, balustrade, or gate, formed from at least one, and preferably a plurality of, elongate rails, and at least one, and preferably a plurality of, pickets. FIGS. 1A and 1B show the barrier system as embodied for example in a picket fence, generally designated by reference numeral 10. The picket fence is rakable such that it may be easily angled at a range of angles to align with sloping terrain while the pickets or balusters remain vertical and parallel with vertical support posts.

The raking barrier panel or fence panel 10 preferably comprises a plurality of spaced vertical support posts, preferably identical in construction, each of which is securely anchored at its base into a substrate, such as the ground, or an underground mass of concrete. The posts are situated along the boundary of the area to be enclosed at least partially by the fence panel 10, with a post spacing which is adequate to impart strength to the fence panel 10 and to securely anchor other fence components. In the FIG. 1 embodiment, a post separation distance of 6-12 feet would be typical. According to one embodiment, the fence panel 10 is manufactured in lengths of six or eight feet. An installer may cut the appropriate manufactured length to fit a particular installation.

Each post is preferably formed from a strong and durable material, such as aluminum. According to an alternate embodiment, the posts may be formed of steel. In order to enhance its resistance to corrosion, the sheet may be subjected to a galvanizing treatment. The sheet is typically subjected to a cold rolling process to form the post into a tubular configuration, preferably having a square/rectangular cross-section. Alternately, the post may be formed with a circular cross-section. Still further, the post may be made of wood, composite or vinyl materials. If desired, a polyester powder coating, painting or other suitable surface treatment may be applied to the post (for example, in order to further enhance corrosion resistance).

With continued reference to FIGS. 1A and 1B, a plurality of barrier panels 10 may form a fence with each panel 10 extending between and supported by a pair of support posts (wherein posts may be shared by two or more panels if necessary). Each panel 10 is formed from a plurality of spaced and parallel rail assemblies 18 (also referred to as rails), and a plurality of spaced and parallel upright members 20, such as the pickets shown in FIGS. 1A and 1B. As shown in FIG. 1A, the upright members 20 forming each panel 10 extend in substantially perpendicular relationship to the rails 18 forming that panel. In an alternate implementation shown in FIG. 1B, the upright members 20 forming each panel 10 do not extend perpendicularly to the rails 18. Rather, the panel 10 is raked (also referred to as racked) at an angle, thus allowing the panel to be used in connection with undulating terrain (or stairs). The angle between the rails and upright members is adjustable (at the installation site), as will be described in more detail below, in order to accommodate panel installation over a variety of terrain features. The panel 10 is thus constructed to support both the FIG. 1A installation with perpendicular rails/pickets, and the FIG. 1B raked installation with non-perpendicular rails/pickets. If desired, a polyester powder coating, painting or other suitable surface treatment may be applied to the panel 10 (for example, in order to further enhance corrosion resistance).

While any number of rails 18 may be provided for each panel 10, FIGS. 1A and 1B show the use of three rails 18 per panel, such as a bottom rail 18*a*, a mid-rail 18*b*, and a top rail 18*c*. Each of the rails has a similar configuration. However, the top rail 18*c* does not include holes through which the pickets 20 extend because the pickets terminate at and do not extend through the top rail 18*c*. According to alternate embodiments, the pickets 20 extend through the top rail 18*c*. The pickets 20 may have an ornamental feature, such as an arrowhead disposed at a top portion above the top rail 18*c*.

A configuration with two rails 18 per panel may alternatively be used. Still further, a configuration with four rails 18 per panel may alternatively be used. The number of upright members 20 provided for each panel 16 should be sufficiently great to assure that the separation distance between adjacent upright members 20, or between a support post and an adjacent upright member 20, will not permit passage therebetween. A separation distance of 2-8 inches is normal. According to one embodiment, the upright members 20 are separated a distance of about four inches, and more specifically about 3.875 inches.

Figure 2:
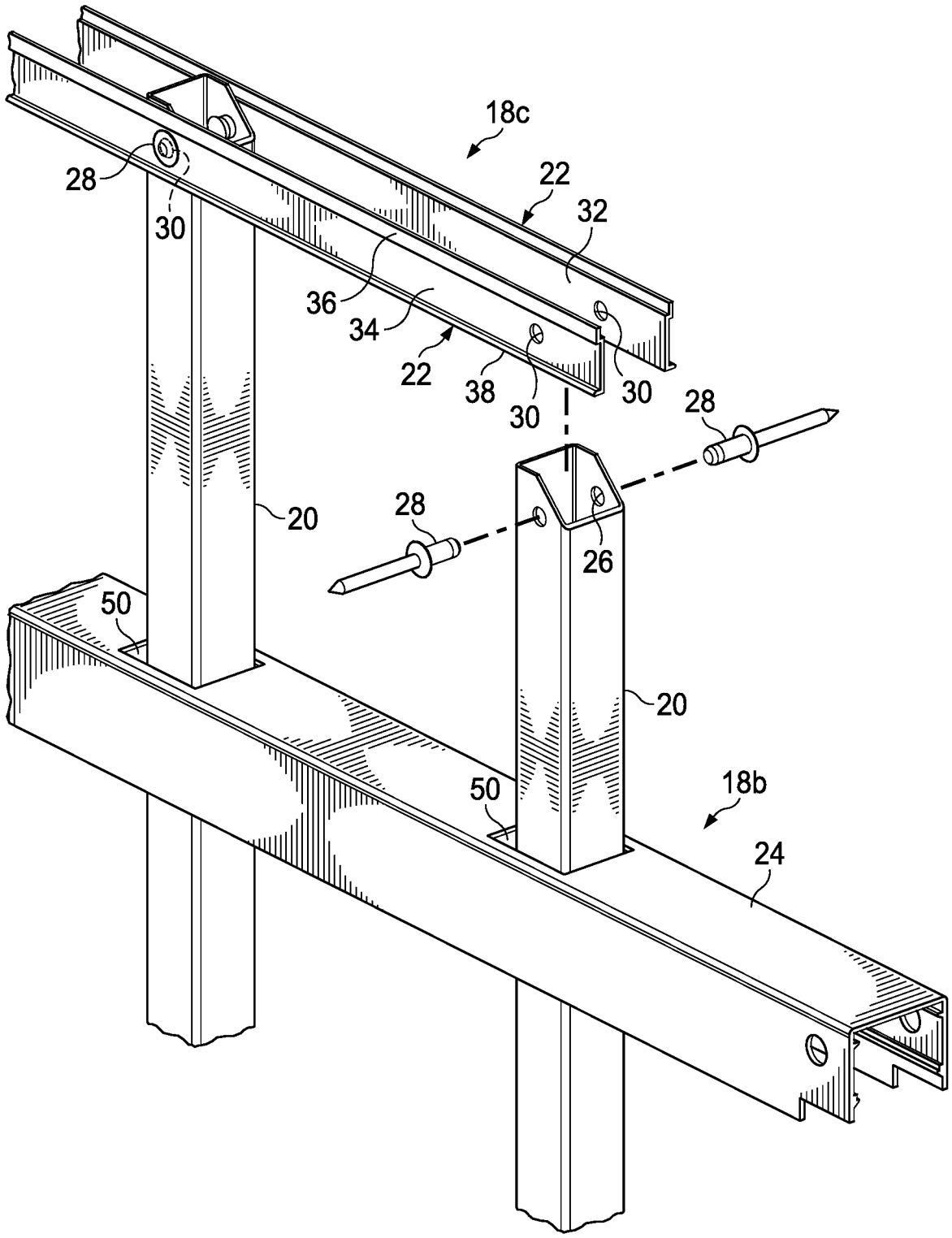
FIG. 2 is an exploded, isometric view of a portion of the raking barrier panel of FIGS. 1A and 1B.
Figure 3:
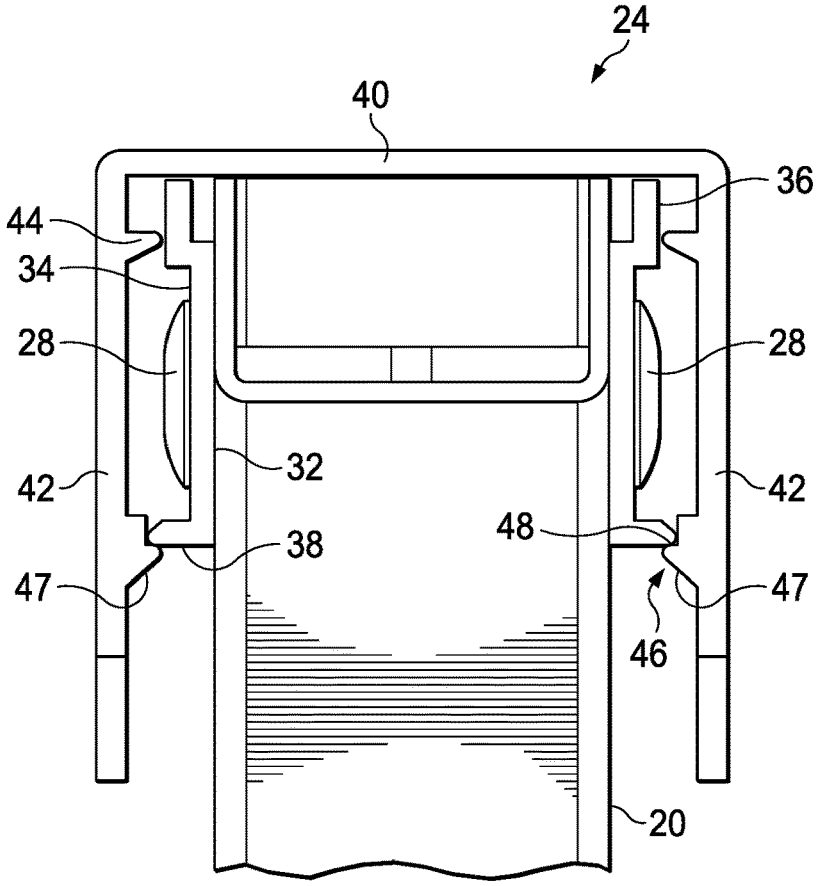
FIG. 3 is an end, elevation view of a portion of the raking barrier panel of FIG. 2.

In connection with an implementation which facilitates raking the panel for installation on undulating terrain, reference is made to FIG. 2, which is an isometric view of a portion of the rakable barrier panel 10 with the channel member of the top rail 18*c* removed. FIG. 3 is a detail end view the connection of the pickets 20 and the top rail 18*c*. Each of the rail members 18*b* and 18*c* includes at least one inner picket rail 22 (see FIG. 5). The embodiment shown in FIGS. 2-3 includes a pair of inner picket rails 22. One inner picket rail 22 is disposed on one side of the upright members 20 and the other inner picket rail 22 is disposed on an opposite side of the upright members 20. A channel member 24 is received over and secured to the inner picket rails 22 (or a single inner picket rail 22, if only one inner picket rail 22 is used).

Each upright member 20 or picket is preferably formed from a strong and durable material, such as aluminum. Alternatively, the upright members 20 may be formed of steel and may be subjected to a galvanizing treatment to enhance resistance to corrosion. According to one embodiment, the upright members are extruded from 6063 T5 aluminum alloy. The aluminum alloy may be extruded to have a particular cross-sectional shape, such as a square or rectangular tubular configuration, although circular and ovular cross-sections are also possible. Alternatively, the upright member may be formed of solid bar stock (with any suitably selected cross-sectional shape). Each of the upright members 20 is preferably sized to be clearly received (i.e., without binding so as to prevent all movement) within the channel member 24 of each rail 18, and further to be clearly received through any openings (to be described in more detail herein) formed in the channel member 24.

Apertures (or holes or dimples) 26 are formed in or through the upright member 20 at spaced apart locations along the length of the upright member 20. For example, the rakable barrier panel 10 includes apertures 26 in the inner picket rails 22 used in the bottom rail 18*a*, the mid-rail 18*b*, and the top rail 18*c*. The apertures 26 are sized to receive a fastener 28 to secure an inner picket rail 22 to the picket 20. The fastener may be any suitable fastener that functions as a pivot axis for the pickets 20. According to embodiments, the fastener 28 may be a screw or an aluminum rod. In the illustrated embodiment, the fastener 28 is a pair of blind rivets (also referred to as pop rivets) inserted on each side of the picket 20. The pop rivets 28 are set to allow the picket 20 to pivot with respect to the inner picket rails 22. According to an alternate embodiment, a pin is received through the aperture 26, at either end of the aperture and possibly extending therethough if desired. The pin forms a pivot axis for enabling the raking of the barrier panel 10. It will, of course be understood that the aperture 26 need not extend completely through the upright 20, but that instead dimples or recesses may be formed on opposite sides of the upright 20 with the pin(s) forming the pivot axes.

According to one embodiment, the pickets 20 do not extend through an opening in the top rail 18*c*. Thus, an end of the picket 20 is cut at an angle to allow clearance for the picket 20 to pivot within the channel member 24 without contacting the web portion 40 of the channel member 24. The angled end provides single direction rakability of the rakable barrier panel 10.

The inner picket rails 22 are formed by extruding a metal material or by forming a sheet metal material. According to one embodiment, the inner picket rails 22 are formed by extruding an aluminum alloy, for example 6061 T5 aluminum alloy, to have the cross section illustrated. Through holes 30 are formed at spaced apart locations along the length of the inner pocket rails 22. The through holes 30 are located at locations where the inner picket rails 22 are attached to the pickets 20. According to certain embodiments, the through holes 30 are formed at 2 to 8 inch intervals. According to one embodiment, the through holes 30 are formed at about 4 inch intervals, or more specifically at 3.875 inch intervals.

The inner picket rail 22 includes a picket contact face 32. A fastener contact face 34 is disposed opposite the picket contact face 32. A channel contacting portion 36 is disposed above the fastener 28 contact face 34 and a ledge 38 disposed below the rivet contact face 34. The ledge 38 may include a beveled surface. The channel contacting portion 36 and the ledge 38 generally extend the length of the inner picket rail 22, and such features may or may not be continuous along the length of the inner picket rail 22. The channel contacting portion 36 and ledge 38 cooperate with corresponding features of the channel member 24 to ensure clearance for the fastener 28 (for example the rivet head) on each side of the pickets 20 between the inner picket rail 22 and the channel member 24. The fasteners 28 are fully concealed by the channel member 24.

Figure 4:
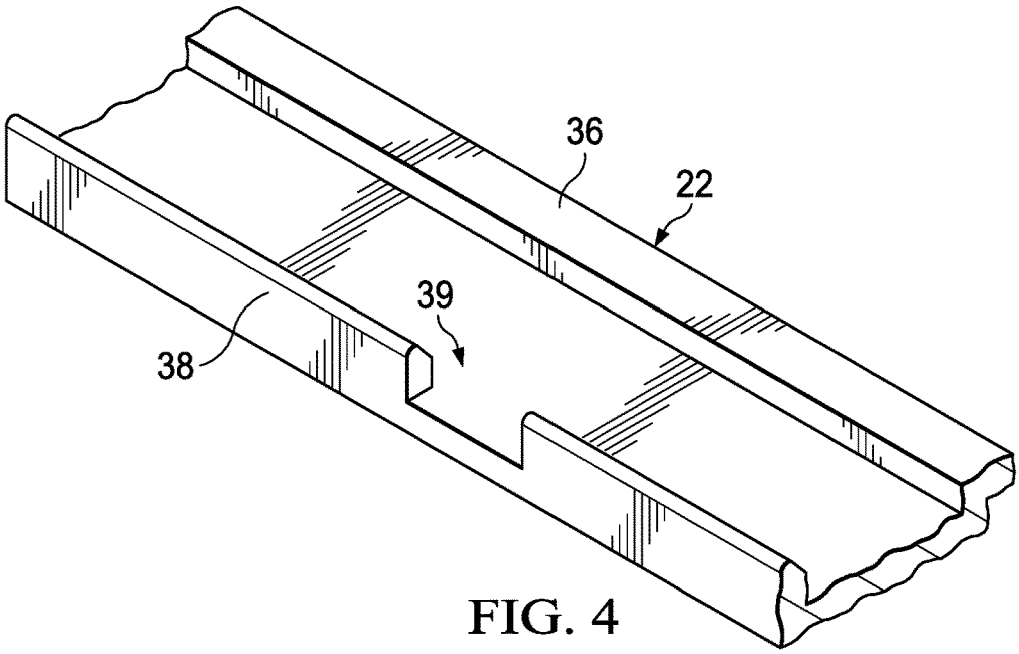
FIG. 4 is an isometric view of an alternate inner picket rail that may be employed with the raking barrier panel of FIGS. 2-3.

According to an alternate embodiment shown in FIG. 4, an inner picket rail 22 may include spaced apart notches 39 (only one notch shown). The notches 39 are formed by removing a portion of the ledge 38. As described in more detail below, a corresponding portion of the lower rib 46 of the channel member 24 may be deformed to engage the notch 39 and further secure the channel member 24 to the inner picket rail 22.

One inner picket rail 22 is positioned such that the picket contact face 32 contacts a plurality of pickets 20 and the through holes 30 align with the apertures 26 of the pickets 20. A fastener 28, for example a blind rivet, is received through each of the aligned through holes 30 and apertures 26 to pivotally secure a first inner picket rail 22 to the pickets 20. A second inner picket rail 22 is positioned with the picket contact face 32 contacting the opposite side of the pickets 20 and the through holes 30 aligned with the apertures 26. A fastener 28, for example a blind rivet, is received through each of the aligned through holes 30 and apertures 26 to secure the second inner picket rail 22 to the pickets 20. Alternatively, any suitable fastener that provides a pivot axis can be used to join the inner picket rails 22 to the pickets 20. For example, a single rod-shaped fastener may be received through the two holes in the picket and the corresponding holes in the two inner picket rails 22.

The channel member 24 comprises an elongate flat web 40 and a pair of opposed side walls 42 which extend from the web 40. The web 40 and side walls 42 collectively define a U-shaped rail channel 24. A flat web 40 is illustrated, but it will be understood that this flat web 40 is not a requirement, and the channel member 24 may alternatively include an elongate web having an arched, rounded or oval shape so long as provision is made for the mounting the channel member 24 to the inner picket rails 22. The length of each channel member 24 should be sufficient to fully span the distance between the adjacent of pair of posts which will support that rail 18, or support the panel 10 into which the rail will be incorporated. Each rail channel member 24 is preferably formed from a strong, durable and conductive material, such as a sheet steel or aluminum. According to one embodiment, the channel member 24 is extruded from a metal, such as an aluminum alloy (i.e. 6061 T5 aluminum alloy), to have the cross section shown. The extrusion is cut to the appropriate length to span the length of the panel 10. If desired, and in order to enhance its resistance to corrosion, the sheet may be subjected to an optional galvanizing treatment. The aluminum alloy of the channel member 24 is sufficiently stiff to provide structural support for the barrier panel 10, particularly under lateral loads.

The cross sectional shape of the channel member 24 includes an upper rib 44 extending from each side wall 42 and running the length of the channel member 24. A lower rib 46 extends from each side wall 42 and runs the length of the channel member 24. The lower rib 46 is disposed below the upper rib 44. The lower rib 46 may include a weld surface 48 that allows the channel member 24 to be securely fastened to the inner picket rails 22. For example, the lower rib 46 may be spot welded to the ledge 38 at spaced apart locations between the upright members 20. Alternatively, an amount of adhesive may be applied to the junction of the lower rib 46 and the ledge 38 at spaced apart locations along the length of the rail assembly 18, specifically at locations between the upright members 20. According to a further alternate embodiment, the lower rib 46 may be deformed to engage a notch 39 in the ledge 38. Regardless of the joining means, the side walls 42 extend downward beyond the lower rib 46, which conceals the spot welds, the adhesive, and the deformed lower rib 46 and provides a clean overall appearance.

The channel members 24 of the bottom rail 18*a* and the mid-rail 18*b* include a plurality of rectangular shaped apertures 50 spaced apart along the web 40. The upright members 20 pass through rectangular openings 50 formed in the web 40 at the positions in the panel 10 where upright members 20 are desired. It will of course be understood that the openings 50 need not in all cases be rectangular, but instead may be oval-shaped especially for use in situations where the upright members have round or oval cross-sections. The rectangular openings 50 are sized to permit the raking functionality but provide a limit to the degree of racking allowed. The non-perpendicular angle of the raking for the panel 10 is selected by the installer on site in accordance with the desired use and terrain conditions. According to an alternate embodiment, the top rail 18*c* may optionally include the rectangular spaced apart apertures 50, similar to the bottom rail 18*a* and the mid-rail 18*b*.

The pickets 20 are received through the apertures 50 in the channel member 24, and the channel member 24 positioned over the pair of inner picket rails 22. The upper rib 44 contacts the channel contacting portion 36 of each inner picket rail 22. The lower rib 46 is received over and in engagement with the ledge 38 of the inner picket rails 22. In this manner, the channel member 24 is interference fit with the inner picket rails 22. More specifically, the lower rib 46 includes an angled surface 47 such that a downward force causes the ledge 38 to flex the side walls 42 of the channel member 24 outward such that the lower rib 46 slides over the ledge 38 and returns to its relaxed state such that the ledge 38 is seated in the lower rib 46. Specifically, the ledge 38 of each inner picket rail 22 is seated on the weld surface 48 of the channel member 24. The channel member 24 is generally secured in position using this press fit installation technique.

As stated above, the cooperation of the channel contacting portions 36 with the upper ribs 44 and the ledges 38 with the lower ribs 46 ensure clearance for a head or other portion of the fastener 28, which is disposed between the inner picket rails 22 and the channel member 24.

According to one embodiment, the lower rib 46 is joined to the ledge 38 of the inner picket rails 22. A variety of joining means may be used. Joining the lower rib 46 to the ledge 38 ensures that the channel member 24 is prevented from moving longitudinally with respect to the inner picket rails 22 and the pickets 20, which are pivotally connected to the inner picket rails 22 as described above. Such joining also ensures that the channel member 24 is not flexed to unintentionally come out of engagement with the inner picket rails 22.

According to one joining means, the lower rib 46 may be spot welded to the ledge 38 at spaced apart locations between the upright members 20. Alternatively, an amount of adhesive may be applied to the junction of the lower rib 46 and the ledge 38 at spaced apart locations along the length of the rail assembly 18, specifically at locations between the upright members 20.

With reference to FIG. 4, notches 39 are formed by removing material from the ledge 38. Using a hammer and a punch, a portion of the lower rib 46 may be deformed to engage the notch 39. This engagement prevents longitudinal movement of the channel member 24 with respect to the inner picket rails 22.

Spot welds, adhesive, or a deformed lower rib received in notches may be positioned approximately 1 foot apart along the length of the rail 18. Regardless of the joining means, the side walls 42 extend downward beyond the lower rib 46, which conceals the spot welds, the adhesive, and the deformed lower rib 46 and provides a clean overall appearance. Alternatively, a mechanical fastener, such as a rivet, screw, bolt, and the like, can be received through the side wall 42 of the channel member 24 and into the inner picket rail 22 at spaced apart intervals along the rail assembly 18.

Figure 5:
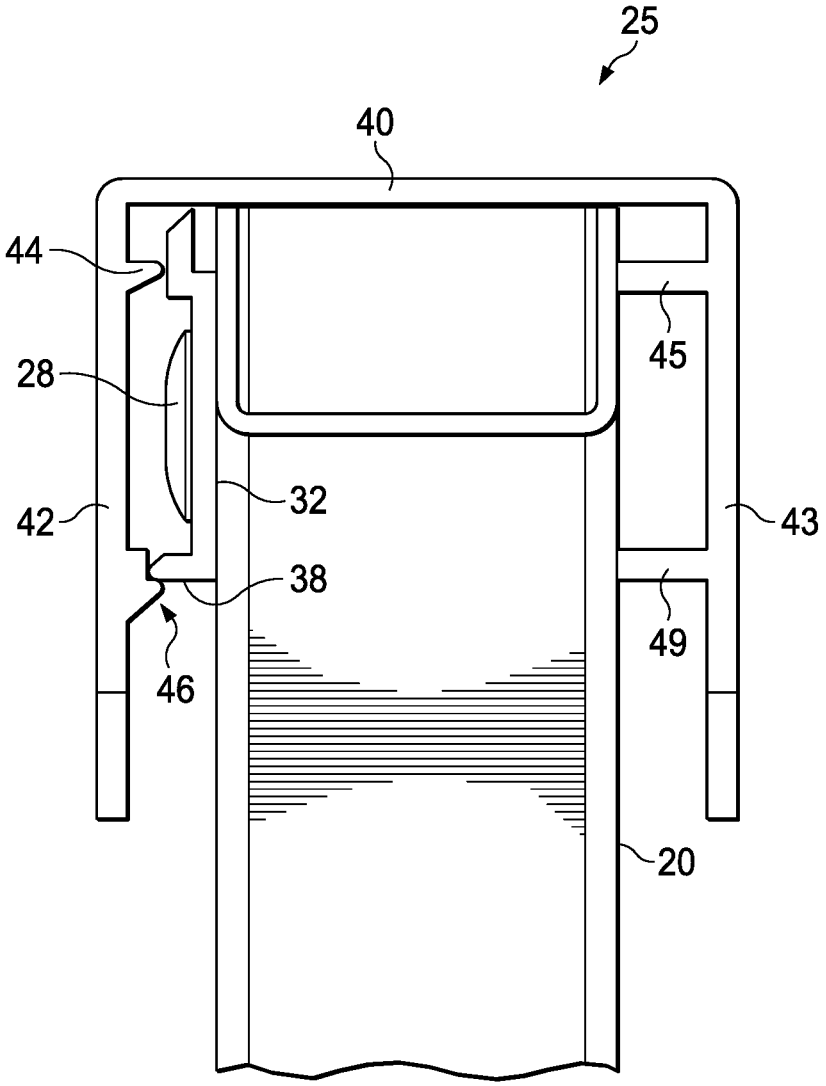
FIG. 5 is an end, elevation view of an alternate embodiment of a raking barrier panel.

Reference is made to FIG. 5, which is an end view of a portion of an alternate embodiment of the rakable barrier panel 10 employing a single inner picket rail 22 and an alternate embodiment of a channel member 25. The inner picket rail 22 is pivotally coupled by rivets 28 or other suitable fastener to one side of the upright members 20, as described with respect to FIGS. 2-3. The channel member 25 includes a web portion 40 and one side wall 42 similar to the channel member 24. An upper rib 44 and a lower rib 46 extend from the side wall 42. A side wall 43 extends from the web portion 40 and is disposed opposite the side wall 42. An upper rib 45 extends from the side wall 43 and contacts the pickets 20. A lower rib 49 extends from the side wall 43 and also contacts the pickets 20. The length of the upper rib 45 and the lower rib 49 ensures that the pickets are generally centered between the side walls 42, 43 of the channel member 25. The contact between the ribs 45, 49 and the pickets 20 does not inhibit the pickets 20 from pivoting with respect to the channel member 25.

The assembly of the rails 18 with the pickets 20 described above allows the raking of the panel such that the angle between the rails 18 and the pickets 20 can be adjusted from perpendicular to non-perpendicular. According to one embodiment, the angle between the rails 18 and the pickets 20 can be adjusted in a range of about 30 degrees to ninety degrees as is used in the square installation shown in FIG. 1A to allow raking of the rakable barrier panel 10 to follow terrain or other sloped features.

Figure 6:
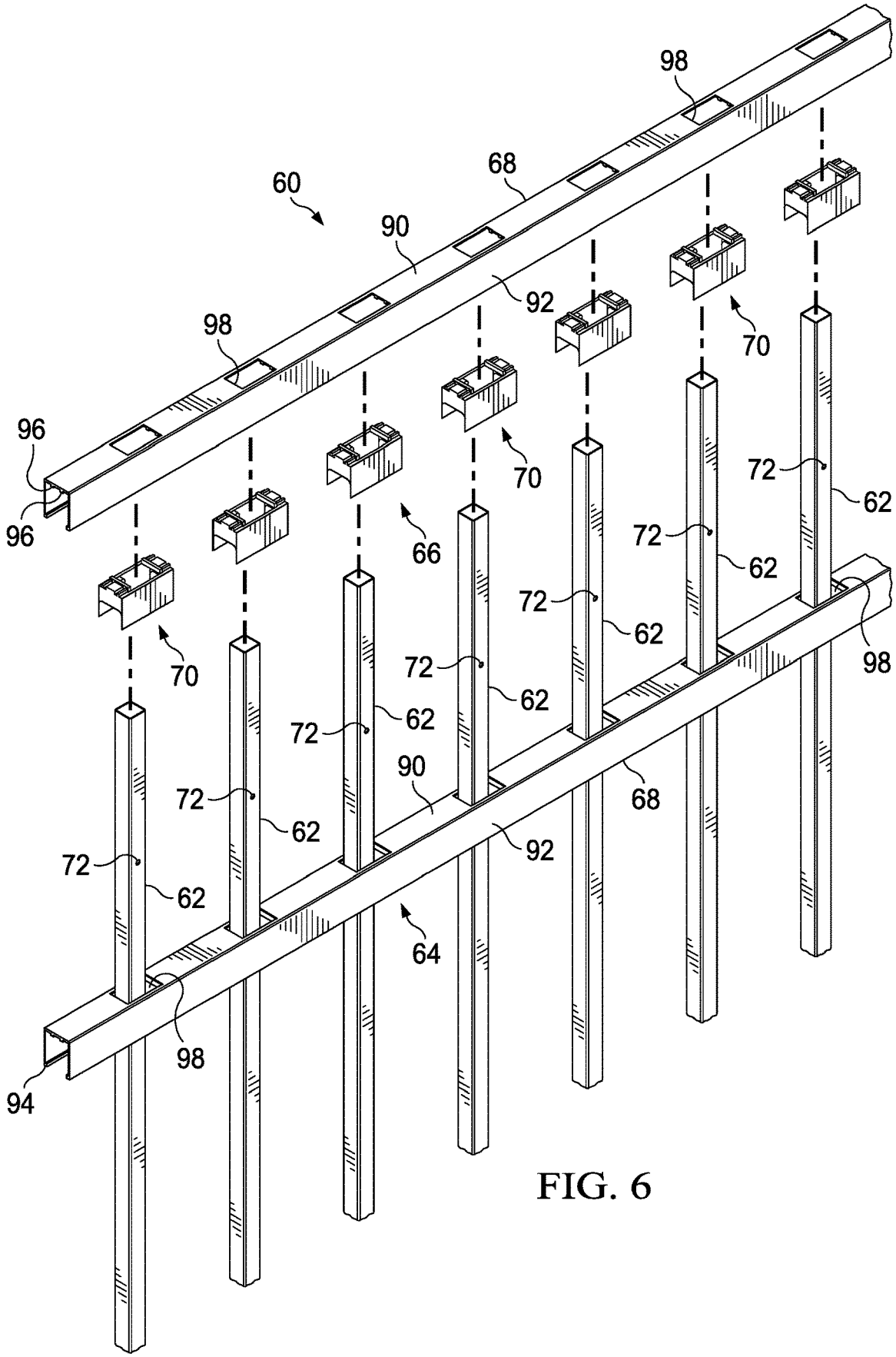
FIG. 6 is an exploded, isometric view of a portion of an alternate embodiment of a raking barrier panel according to the teachings of the present disclosure.

Reference is made to FIG. 6, which is an exploded, isometric view of a portion of a rakable barrier panel 60 according to an alternate embodiment of the present disclosure. The rakable barrier panel 60 includes a plurality of pickets 62, which are pivotable with respect to a mid-rail assembly 64 and a top rail assembly 66. The bottom rail assembly is identical to the mid-rail assembly 64, and is therefore omitted from FIG. 6 and will not be separately described. Each of the mid-rail and top rail assemblies 64, 66 include a channel member 68 and a plurality of picket pivot members 70. A picket pivot member 70 is disposed at each pivot location of a picket 62 with respect to a rail assembly 64, 66. In the illustrated embodiment, seven pickets 62 are shown as having two picket points per rail assembly. Thus, 14 picket pivot members 70 are included in the portion of the rakable barrier panel 60 shown in FIG. 6.

Figure 7:
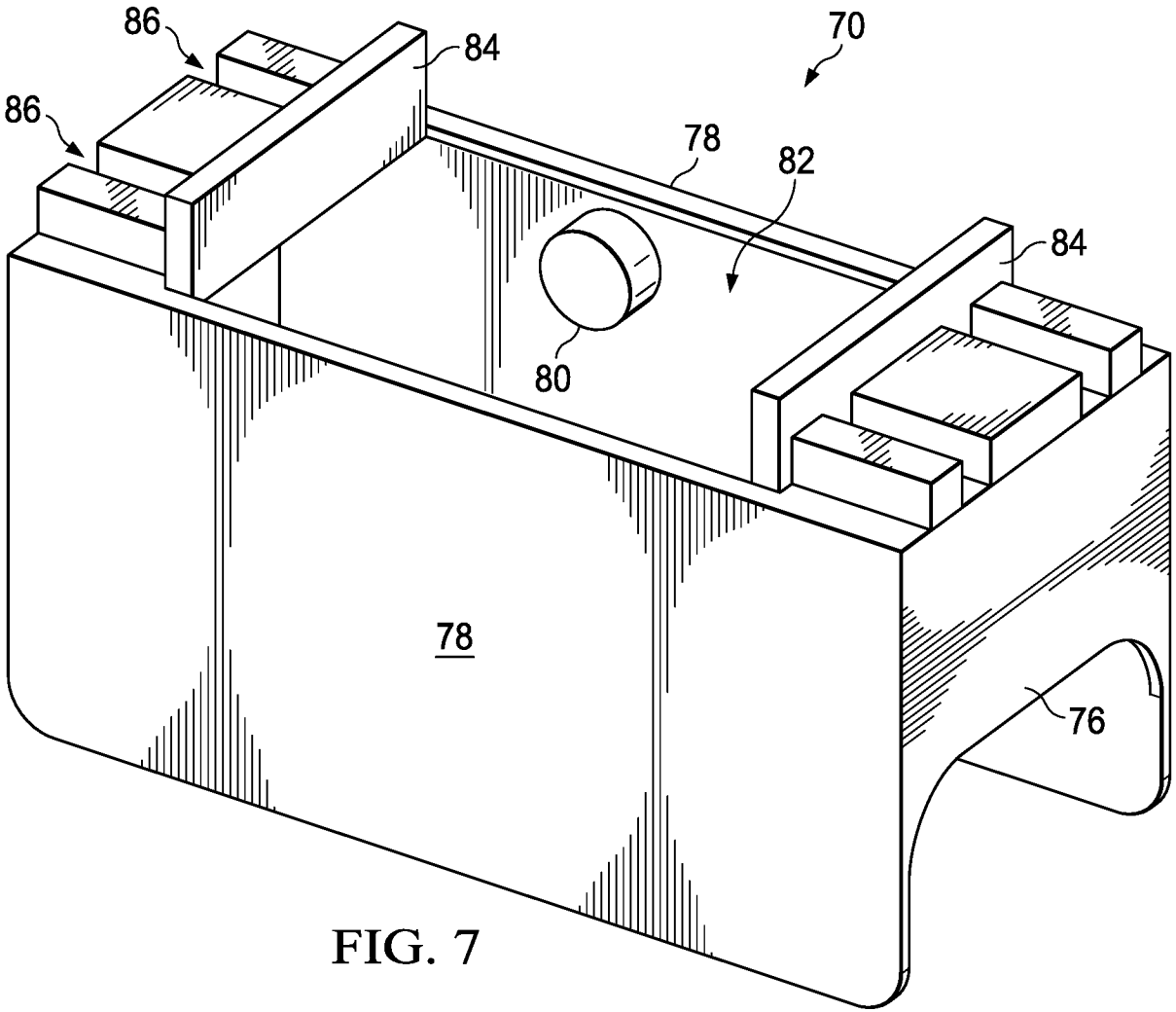
FIG. 7 is an isometric view of a picket pivot member of the raking barrier pane of FIG. 6.

The pickets are formed of a rigid material, such as an aluminum extrusion, as described in more detail with respect to the pickets 20, shown in FIGS. 2-3. A hole 72 is formed on opposite side walls of each picket corresponding to pin portions 80 of the picket pivot member 70. FIG. 7 is an isometric view of a picket pivot member 70 according to an embodiment of the present disclosure. The picket pivot member 70 is generally formed in rectangular, box-like shape. The picket pivot member 70 includes a pair of opposed end walls 76 and a pair of opposed side walls 78. A pin portion 80 extends from an interior surface of each side wall 78. The pin portions 80 are received in the holes 72 formed in the pickets 62 and form a pivot axis. The picket 62 pivots about the pin portion 80. The picket 62 extends through the picket pivot member 70 and through a rectangular opening 82 in an upper portion of the picket pivot member 70. The rectangular opening 82 provides clearance to allow the picket 62 to pivot within the opening 82. A retainer wall 84 is disposed on each side of the opening 82. The retainer wall cooperates with the rectangular opening 98 in the channel member 68 to constrain movement of the picket pivot member 70 along the channel member 68. A plurality of notches 86 are formed in the upper portion of the picket pivot member 70. The notches 86 receive web ribs 96 of the channel member 68 to further constrain the picket pivot member 70.

The picket pivot member 70 is formed of a semi-rigid material such as a polymeric material. The picket pivot member 70 may be injection molded or may be formed using other known processes for forming polymeric materials. According to one embodiment, the picket pivot members 70 are formed by injection molding a polymeric material, such as polypropylene or polyethylene. This material provides a durable member 70 that is still able to flex and elastically deform slightly to facilitate assembly onto the pickets, as described in more detail below.

Returning to FIG. 6, the channel members 68 include a web 90 and a pair of side walls 92 extending from the web 90 and forming a generally U-shape in cross section. A ledge 94 extends from each side wall 92 and runs the length of the channel member 68. The ledge 94 may be shaped similar to the ledge 46 described with respect to FIGS. 2-3. The ledges 94 cooperate with the side walls 78 of the picket pivot member 70 to retain the picket pivot member 70 within the channel member 68. A pair of web ribs 96 that extend from an interior surface of the web portion 90. The web ribs 96 generally run the length of the channel member 68. As stated above, a portion of the web ribs 96 are received in the notches 86 in the picket pivot member 70 to constrain the picket pivot members 70 within the channel member 68. The channel member 68 may be formed of any suitable rigid material, such as aluminum or steel. In one embodiment, the channel member 68 is formed by extruding an aluminum alloy, for example 6061 T5 aluminum alloy.

A plurality of rectangular through holes 98 are formed in the web portion 90. The opening 82 in the picket pivot member 70 is aligned with a corresponding rectangular through hole 98 in the web portion 90 and the picket 62 extends through the opening 82 and the rectangular through hole 98. Similar to the embodiment shown in FIGS. 2-3, the rectangular through hole 98 allows clearance for the pickets 62 to pivot through an angle with respect to the rail assemblies 64, 66.

In the embodiment illustrated in FIG. 6 upper ends of the pickets 62 extend through the top rail assembly 66. In an alternate embodiment, the upper ends of the pickets 62 may terminate at the top rail assembly 66, and therefore the upper ends may include an angled surface to allow clearance for the upper end when the picket 62 is pivoted.

The rakable barrier panel 60 illustrated in FIG. 6 is assembled by placing the pickets 62 in a jig. The picket pivot members 70 are received over either a top end or a bottom end of each picket 62. The picket pivot member 70 can be elastically deformed slightly to allow the pin portions 80 to clear the pickets 62 as the picket pivot member 70 is slid over the end of the picket and into position where the pin portions 80 can be received in the holes 72 in the pickets 62.

Figure 8:
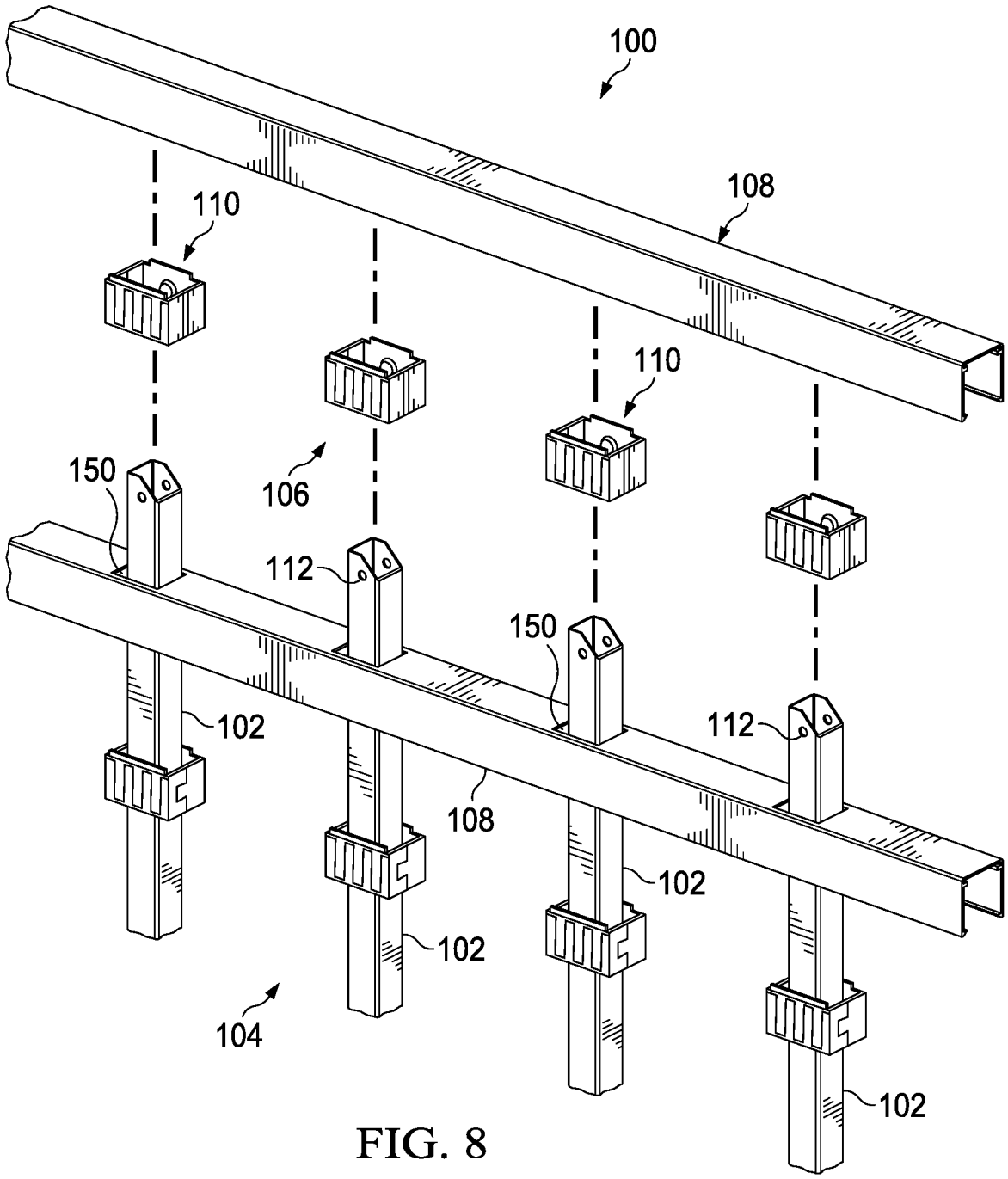
FIG. 8 is an exploded, isometric view of a portion of an alternate embodiment of a raking barrier panel according to the teachings of the present disclosure.

Reference is made to FIG. 8, which is an exploded, isometric view of a portion of a rakable barrier panel 100 according to an alternate embodiment of the present disclosure. The rakable barrier panel 100 includes a plurality of pickets 102, which are pivotable with respect to a mid-rail assembly 104 and a top rail assembly 106. The bottom rail assembly is identical to the mid-rail assembly 104, and is therefore omitted from FIG. 8 and will not be separately described. Each of the mid-rail and top rail assemblies 104, 106 include a channel member 108 and a plurality of picket pivot members 110. A picket pivot member 110 is disposed at each pivot location of a picket 102 with respect to a rail assembly 104, 106. In the illustrated embodiment, four pickets 102 are shown as having two picket points per rail assembly. Thus, eight picket pivot members 110 are included in the portion of the rakable barrier panel 100 shown in FIG. 8.

As described in more detail below, the picket pivot members 110 include a living hinge such that they may be expanded to fit over the pickets 110. In this manner, the picket pivot members 110 may be expanded and positioned on the pickets 102 at the location of the pivot holes. This may eliminate the need for the hinged picket pivot member 110 to be received over the top or bottom end of the picket 102. Expanding the hinged picket pivot member 110 may reduce instances of marred or otherwise blemished powder coating of the pickets 110 that might otherwise result if the end receiving picket pivot members 70, shown in FIGS. 6-7 are used.

Figure 9:
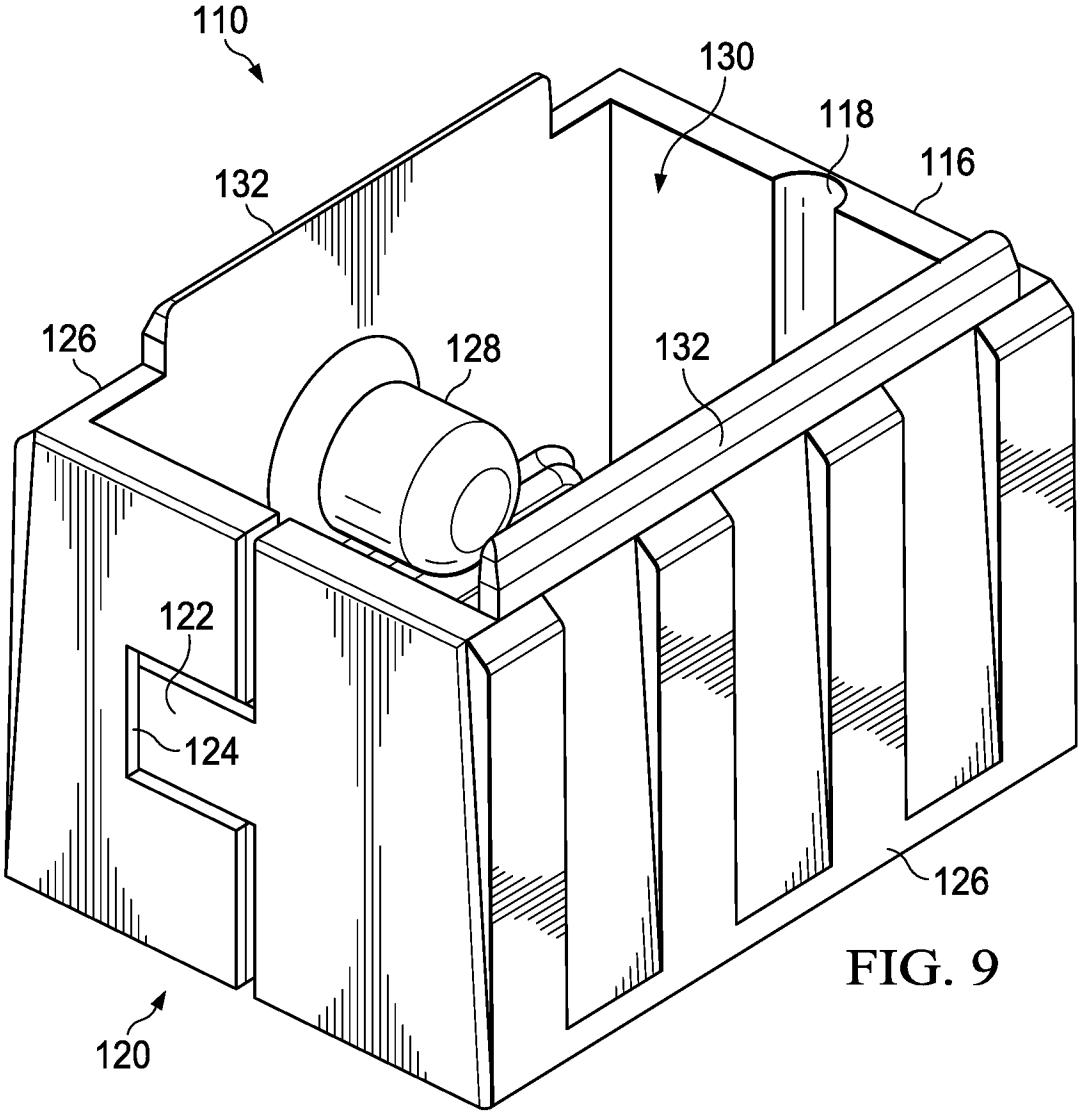
FIG. 9 is an isometric view of a picket pivot member of the raking barrier pane of FIG. 8.

The pickets 102 are formed of a rigid material, such as an aluminum extrusion, as described in more detail with respect to the pickets 20, shown in FIGS. 2-3. A hole 112 is formed on opposite side walls of each picket 102 corresponding to pin portions of the picket pivot member 110. FIG. 9 is an isometric view of a picket pivot member 110 according to an embodiment of the present disclosure. The picket pivot member 110 has a generally rectangular, box-like shape. The picket pivot member 110 includes a rear end wall 116 in which a living hinge 118 is formed. Opposite the rear end wall 116 is a mated end wall 120. One portion of the mated end wall 120 includes a clip 122 and an adjacent portion of the mated end wall 120 includes a clip receiving feature 124. A pair of side walls 126 is disposed between the rear end wall 116 and the mated end wall 120.

A pin portion 128 extends from an interior surface of each side wall 126. The pin portions 128 are received in the holes 112 formed in the pickets 102 and form a pivot axis. The picket 102 pivots about the pin portions 128. The picket 102 extends through the picket pivot member 110 and through a rectangular opening 130 in an upper portion of the picket pivot member 110. The rectangular opening 130 provides clearance to allow the picket 102 to pivot within the opening 130. A retainer wall 132 is disposed on each side of the opening 130. The retainer walls 132 cooperate with the channel member 108 to constrain movement of the picket pivot member 110 along the channel member 108, as described in more detail below.

The picket pivot member 110 is formed of a semi-rigid material such as a polymeric material. The picket pivot member 110 may be injection molded or may be formed using other known processes for forming polymeric materials. According to one embodiment, the picket pivot members 110 are formed by injection molding a polymeric material, such as polypropylene or polyethylene. According to one embodiment, the picket pivot member 110 is formed with the portions of the mated end wall separate from each other. A reduced thickness portion forms the living hinge 118. The picket pivot member 110 may be flexed and bent at the living hinge 118 such that the clip 122 is received in the clip receiving feature 124 to form the box-like shape shown in FIGS. 8 and 9. More specifically, a projection from the clip 122 is received in a recess in the clip receiving feature 124.

Figure 10:
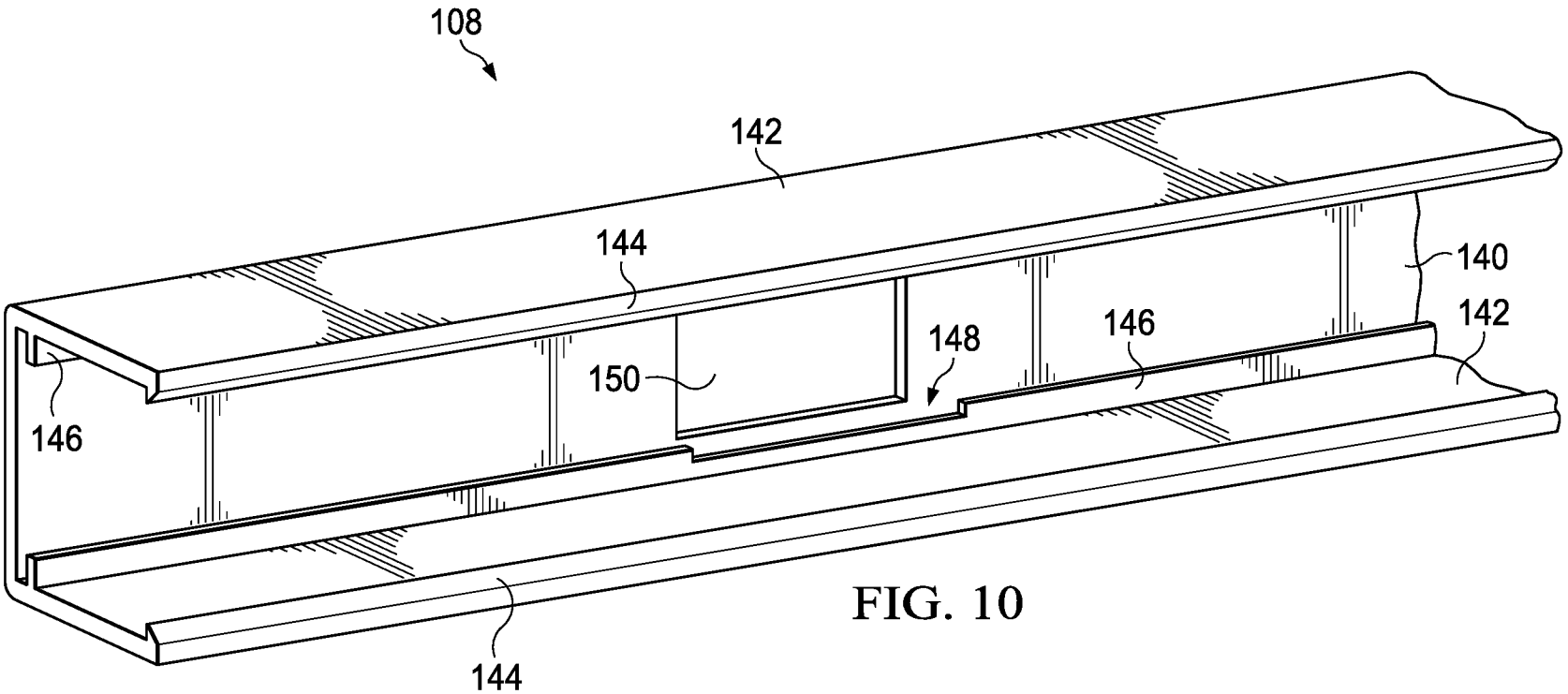
FIG. 10 is an isometric view of a channel member of the raking barrier panel of FIG. 8.

FIG. 10 is an isometric view of the channel member 108 shown in FIG. 6. The channel members 108 include a web 140 and a pair of side walls 142 extending from the web 140 and forming a generally U-shape in cross section. A ledge 144 extends from each side wall 142 and runs the length of the channel member 108. The ledge 144 may be shaped similar to the ledge 46 described with respect to FIGS. 2-3. The ledges 144 cooperate with the side walls 126 of the picket pivot member 110 to retain the picket pivot member 110 within the channel member 108. A pair of upper ribs 146 extends from an interior surface of the side walls 142. The upper ribs 146 generally run the length of the channel member 108, with the exception of cutouts 148 formed proximate rectangular through holes 150 formed in the web 140. The cutouts 148 receive the retainer walls 132 of the picket pivot member 110 to constrain possible motion of the picket pivot member with respect to the channel member 108 in a longitudinal direction.

The channel member 108 may be formed of any suitable rigid material, such as aluminum. In one embodiment, the channel member 108 is formed by extruding an aluminum alloy, for example 6061 T5 aluminum alloy.

A plurality of rectangular through holes 150 are formed in the web portion 140. The picket pivot member 110 is aligned with a corresponding rectangular through hole 150 in the web portion 140 and the picket 102 extends through the picket pivot member 110 and the rectangular through hole 150. Similar to the embodiment shown in FIGS. 6-7, the rectangular through hole 150 allows clearance for the pickets 102 to pivot through an angle with respect to the rail assembly 104.

In the embodiment illustrated in FIG. 8 upper ends of the pickets 102 terminate at the top rail assembly 106. Each picket 102 includes an angled surface to allow clearance for the upper end when the picket 102 is pivoted with respect to the top rail assembly 106. In an alternate embodiment, the upper ends of the pickets may extend through the channel member 108. In such embodiment, the channel member 108 of the top rail assembly includes a plurality of rectangular through holes, similar to the mid-rail assembly.

The rakable barrier panel 100 illustrated in FIG. 8 is assembled by placing the pickets 102 in a jig. The picket pivot members 110 are expanded and flexed at the living hinge such that they can be received over the picket 102. The clip portion 122 is received in the clip receiving feature 124 to secure the picket pivot member 110 over the picket 102 and secure the pin portions 128 in the pivot holes 112 formed in the walls of the picket. As the picket pivot members 110 can be flexed to provide able clearance from the pickets 102 during assembly, the pin portions 128 may be made longer than the similar pin portions 80 shown in FIG. 7. A more secure connection may result.

When installed on horizontal terrain, as shown in FIG. 1A, the rails 18 are disposed substantially horizontally and upright members substantially vertically. When installed on non-horizontal terrain, as shown in FIG. 1B, the pivot provided through the pivot axes allows the panel to be racked to a selected angle such that the rails 18 are disposed substantially parallel with the non-horizontal terrain while the upright members 20 remain substantially vertical. The rectangular openings are sized to permit the racking operation but provide a limit to the degree of racking allowed. The non-perpendicular angle of the racking for the panel is selected by the installer on site in accordance with the desired use and terrain conditions.

Thus, the design is for both fencing and railing products that can be used in both flat and undulating terrain, deck railing and/or for stair railing. Unlike fencing and railing products made specifically for flat or undulating terrain, or stairs, the design of this panel allows it to be used in flat installation or racked for stair or undulating installations.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A raking barrier panel, comprising:

a plurality of pickets, each comprising a pivot pin hole;

a channel member comprising a web wall defining a plurality of spaced apart openings each receiving a respective one of the plurality of pickets therethrough; and a plurality of picket pivot members in snap-fit engagement with the channel member, each one of the plurality of picket pivot members comprising a pair of opposed end walls and a pair of opposed side walls together forming a box-like shape, and a pivot pin extending from at least one of the pair of opposed side walls and being received by the pivot pin hole of a respective one of the plurality of pickets to define a pivot axis with respect to the channel member;

wherein each pivot axis lies substantially perpendicular to the length of the channel member;

wherein each of the pickets is pivotable about the pivot axis of a respective pivot pin to allow adjustment of a rake angle.

2. The raking barrier panel of claim 1 wherein the pair of opposed end walls, the pair of opposed side walls, and the pivot pin of each one of the plurality of picket pivot members are portions of a same unitary body.

3. The raking barrier panel of claim 2 wherein each one of the plurality of picket pivot members is formed of a polymeric material.

4. The raking barrier panel of claim 1 wherein each one of the plurality of picket pivot members further comprises a retainer wall cooperating with the channel member to constrain the respective picket pivot member with respect to the channel member.

5. The raking barrier panel of claim 1 wherein the pivot pin hole extends through each one of the plurality of pickets and each one of the plurality of picket pivot members further comprises a second pivot pin received in the pivot pin hole.

6. The raking barrier panel of claim 1 wherein one of the opposed side walls of each one of the plurality of picket pivot members includes portions that are separable from each other.

7. The raking barrier panel of claim 6 wherein one of the pair of opposed end walls of each one of the plurality of picket pivot members includes a living hinge.

8. A raking barrier panel, comprising:

a plurality of pickets, each comprising a pivot pin hole;

a channel member comprising a web wall, and a ledge running the length of the channel member, the web wall defining a plurality of spaced apart openings each receiving one of the plurality of pickets therethrough; and a plurality of picket pivot members, each disposed within the channel member proximate one of the plurality of spaced apart openings and comprising a pair of end walls, a first side wall, and a second side wall together forming a box-like shape, and a pin extending from either the first side wall or the second side wall and being received by the pivot pin hole of one of the plurality of pickets to form a pivot axis;

wherein each pivot axis lies in a direction substantially perpendicular to the length of the channel member;

wherein the ledge cooperates with the first side wall of each one of the plurality of picket pivot members to hold the plurality of picket pivot members within the channel member and each of the pickets is pivotable about the pivot axis of a respective pin to allow adjustment of a rake angle.

9. The raking barrier panel of claim 8 wherein each one of the plurality of picket pivot members further comprises at least one retainer wall cooperating with the channel member to constrain the respective picket pivot member with respect to the channel member.

10. The raking barrier panel of claim 9 wherein the channel member further comprises a rib extending from an interior surface of the channel member, the rib in engagement with the retainer wall of each one of the plurality of picket pivot members.

11. The raking barrier panel of claim 8 wherein each one of the plurality of picket pivot members is formed of a semi-rigid material.

12. The raking barrier panel of claim 8 wherein one of the pair of end walls of each one of the plurality of picket pivot members is a mated end wall.

13. The raking barrier panel of claim 12 wherein one of the pair of end walls of each one of the plurality of picket pivot members comprises a living hinge.

14. The raking barrier panel of claim 8 wherein the pair of end walls, the first side wall, the second side wall, and the pivot pin of each one of the plurality of picket pivot members are portions of the same unitary body.

15. A raking barrier panel, comprising:

a plurality of pickets, each comprising a pivot pin hole;

a channel member comprising a web wall, a first side wall extending from the web wall, and a second side wall extending from the web wall, a first ledge extending from the first side wall and running the length of the channel member, and a second ledge extending from the second side wall and running the length of the channel member, the web wall defining a plurality of spaced apart openings each receiving one of the plurality of pickets therethrough; and a plurality of picket pivot members, each disposed within the channel member proximate one of the plurality of spaced apart openings and comprising a pair of end walls, a first side wall, and a second side wall, at least one retainer wall, and a pin extending from the first side wall and being received by the pivot pin hole of one of the plurality of pickets to form a pivot axis;

wherein each pivot axis lies in a direction substantially perpendicular to the length of the channel member;

wherein the first ledge cooperates with the first side wall of each one of the plurality of picket pivot members and the second ledge cooperates with the second side wall of each one of the plurality of picket pivot members to hold the plurality of picket pivot members within the channel member and the at least one retainer wall of each one of the plurality of picket pivot members cooperates with the channel member to constrain the respective picket pivot member with respect to the channel member;

wherein each of the pickets is pivotable about the pivot axis of a respective pin to allow adjustment of a rake angle.

16. The raking barrier panel of claim 15 wherein the channel member further comprises at least one rib extending from an interior surface of the channel member.

17. The raking barrier panel of claim 16 wherein the at least one rib cooperates with the at least one retainer wall of each one of the plurality of picket pivot members to constrain the plurality of picket pivot members with respect to the channel member.

18. The raking barrier panel of claim 15 wherein each one of the plurality of picket pivot members is formed of a semi-rigid material.

19. The raking barrier panel of claim 15 wherein for each one of the plurality of picket pivot members the pair of end walls, the first side wall, the second side wall, the at least one retainer wall, and the pin are all portions of the same unitary body.

20. The raking barrier panel of claim 15 wherein the pivot pin hole extends through each one of the plurality of pickets and each one of the plurality of picket pivot members further comprises a second pivot pin received in the pivot pin hole.

* * * * *